US006121952A

United States Patent [19]

Igari

[11] Patent Number: 6,121,952

[45] Date of Patent: Sep. 19, 2000

[54] GRAY SCALE DISPLAY CONTROL DEVICE

[75] Inventor: Shozi Igari, Fukushima-ken, Japan

[73] Assignee: Alps Electric Co., Ltd., Tokyo, Japan

[21] Appl. No.: 08/916,852

[22] Filed: Aug. 22, 1997

[30] Foreign Application Priority Data

Sep. 4, 1996 [JP] Japan ..... 8-253837

[51] Int. Cl.[7] ..... G09G 5/10

[52] U.S. Cl. ..... 345/147; 345/89; 345/152; 345/212; 345/507; 347/15; 348/245

[58] Field of Search ..... 345/147, 152, 345/212–215, 432, 507, 89; 347/15; 348/245

[56] References Cited

U.S. PATENT DOCUMENTS 5,122,783 6/1992 Bassetti, Jr. ..... 340/701
5,153,568 10/1992 Shaw ..... 340/703
5,298,915 3/1994 Bassetti, Jr. ..... 345/149

*Primary Examiner*—Richard A. Hjerpe
*Assistant Examiner*—Henry N. Tran
*Attorney, Agent, or Firm*—Brinks Hofer Gilson & Lione

[57] ABSTRACT

A gray scale display control device by which flickers occurring in a gray scale display are reduced. This gray scale display control device is provided with: a blink data storing unit for storing blink data by which pixel groups of a display portion are blinked correspondingly to a gray scale; a blink data generating unit, to which the blink data stored in the blink data storing unit is written, for outputting the blink data written thereto to the display portion in such a manner as to be in a predetermined arrangement; and a blink data arrangement unit for determining an order in which the blink data written to the blink data generating unit are respectively arranged in the pixel groups. In this gray scale display control device, the blink data written to the blink data generating unit is adapted to be able to be rewritten.

3 Claims, 12 Drawing Sheets

NO.DATA
FRM
LOAD
CP
DATA FROM CPU RAM
ADDRESS FROM CPU
IMAGE DATA FROM VIDEO MEMORY
WRITE SIGNAL

| TONE LEVEL \ BIT NO. | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| K 1 | 1 | 0 | 0 | 0 | 0 | 0 | 0 | 0 | 1 | 0 | 0 | 0 | 0 | 0 | 0 | 0 |
| K 2 | 1 | 0 | 0 | 0 | 1 | 0 | 0 | 0 | 1 | 0 | 0 | 0 | 0 | 0 | 0 | 0 |
| K 3 | 1 | 0 | 0 | 0 | 1 | 0 | 0 | 0 | 1 | 0 | 0 | 0 | 1 | 0 | 0 | 0 |
| K 4 | 1 | 0 | 0 | 1 | 0 | 0 | 1 | 0 | 0 | 0 | 1 | 0 | 0 | 1 | 0 | 0 |
| K 5 | 1 | 0 | 0 | 1 | 0 | 1 | 0 | 0 | 1 | 0 | 0 | 1 | 0 | 1 | 0 | 0 |
| K 6 | 0 | 0 | 1 | 0 | 0 | 0 | 1 | 1 | 0 | 0 | 1 | 1 | 0 | 0 | 1 | 1 |
| K 7 | 0 | 1 | 0 | 1 | 0 | 1 | 0 | 1 | 0 | 1 | 0 | 1 | 0 | 1 | 0 | 1 |
| K 8 | 0 | 1 | 1 | 0 | 1 | 1 | 0 | 0 | 0 | 1 | 1 | 0 | 1 | 1 | 1 | 0 |
| K 9 | 1 | 1 | 0 | 1 | 0 | 1 | 0 | 1 | 1 | 1 | 0 | 1 | 0 | 1 | 0 | 1 |
| K A | 1 | 1 | 0 | 0 | 1 | 1 | 1 | 0 | 1 | 1 | 1 | 0 | 1 | 1 | 1 | 0 |
| K B | 1 | 0 | 1 | 1 | 1 | 0 | 1 | 1 | 1 | 0 | 1 | 1 | 1 | 0 | 1 | 1 |
| K C | 1 | 0 | 1 | 1 | 1 | 0 | 1 | 1 | 1 | 0 | 1 | 1 | 1 | 1 | 1 | 1 |
| K D | 1 | 0 | 1 | 1 | 1 | 1 | 1 | 1 | 1 | 0 | 1 | 1 | 1 | 1 | 1 | 1 |
| K E | 1 | 0 | 1 | 1 | 1 | 1 | 1 | 1 | 1 | 1 | 1 | 1 | 1 | 1 | 1 | 1 |
| K F | 1 | 1 | 1 | 1 | 1 | 1 | 1 | 1 | 1 | 1 | 1 | 1 | 1 | 1 | 1 | 1 |

FIG. 5

| INPUT TO DECODER 10 (IMAGE DATA) | OUTPUT OF DECODER 10 |
|---|---|
| 0 0 0 0 | k 0 |
| 0 0 0 1 | k 1 |
| 0 0 1 0 | k 2 |
| 0 0 1 1 | k 3 |
| 0 1 0 0 | k 4 |
| 0 1 0 1 | k 5 |
| 0 1 1 0 | k 6 |
| 0 1 1 1 | k 7 |
| 1 0 0 0 | k 8 |
| 1 0 0 1 | k 9 |
| 1 0 1 0 | k A |
| 1 0 1 1 | k B |
| 1 1 0 0 | k C |
| 1 1 0 1 | k D |
| 1 1 1 0 | k E |
| 1 1 1 1 | k F |

FIG. 6

| INPUT TO DECODER 16 | OUTPUT OF DECODER 16 |
|---|---|
| 0 0 0 0 | 0 |
| 0 0 0 1 | 1 |
| 0 0 1 0 | 2 |
| 0 0 1 1 | 3 |
| 0 1 0 0 | 4 |
| 0 1 0 1 | 5 |
| 0 1 1 0 | 6 |
| 0 1 1 1 | 7 |
| 1 0 0 0 | 8 |
| 1 0 0 1 | 9 |
| 1 0 1 0 | A |
| 1 0 1 1 | B |
| 1 1 0 0 | C |
| 1 1 0 1 | D |
| 1 1 1 0 | E |
| 1 1 1 1 | F |

FIG. 7

| CP | OUTPUT DATA OF ADDER |
|---|---|
| 1 | 0 0 0 0 |
| 2 | 0 0 1 0 |
| 3 | 1 0 0 0 |
| 4 | 1 0 1 0 |
| 5 | 0 1 0 0 |
| 6 | 0 1 1 0 |
| 7 | 1 1 0 0 |
| 8 | 1 1 1 0 |
| 9 | 0 0 0 1 |
| 10 | 0 0 1 1 |
| 11 | 1 0 0 1 |
| 12 | 1 0 1 1 |
| 13 | 0 1 0 1 |
| 14 | 0 1 1 1 |
| 15 | 1 0 0 1 |
| 16 | 1 1 1 1 |

FIG. 8

F 0

| | | | |
|---|---|---|---|
| 0 | 2 | 8 | A |
| 4 | 6 | C | E |
| 1 | 3 | 9 | B |
| 5 | 7 | D | F |

F 1

| | | | |
|---|---|---|---|
| 1 | 3 | 9 | B |
| 5 | 7 | D | F |
| 2 | 4 | A | C |
| 6 | 8 | E | O |

F 2

| | | | |
|---|---|---|---|
| 2 | 4 | A | C |
| 6 | 8 | E | O |
| 3 | 5 | B | D |
| 7 | 9 | F | 1 |

F 3

| | | | |
|---|---|---|---|
| 3 | 5 | B | D |
| 7 | 9 | F | 1 |
| 4 | 6 | C | E |
| 8 | A | O | 2 |

F 4

| | | | |
|---|---|---|---|
| 4 | 6 | C | E |
| 8 | A | O | 2 |
| 5 | 7 | D | F |
| 9 | B | 1 | 3 |

F 5

| | | | |
|---|---|---|---|
| 5 | 7 | D | F |
| 9 | B | 1 | 3 |
| 6 | 8 | E | O |
| A | C | 2 | 4 |

F 6

| | | | |
|---|---|---|---|
| 6 | 8 | E | O |
| A | C | 2 | 4 |
| 7 | 9 | F | 1 |
| B | D | 3 | 5 |

F 7

| | | | |
|---|---|---|---|
| 7 | 9 | F | 1 |
| B | D | 3 | 5 |
| 8 | A | O | 2 |
| C | E | 4 | 6 |

F 8

| | | | |
|---|---|---|---|
| 8 | A | O | 2 |
| C | E | 4 | 6 |
| 9 | B | 1 | 3 |
| D | F | 5 | 7 |

F 9

| | | | |
|---|---|---|---|
| 9 | B | 1 | 3 |
| D | F | 5 | 7 |
| A | C | 2 | 4 |
| E | O | 6 | 8 |

F A

| | | | |
|---|---|---|---|
| A | C | 2 | 4 |
| E | O | 6 | 8 |
| B | D | 3 | 5 |
| F | 1 | 7 | 9 |

F B

| | | | |
|---|---|---|---|
| B | D | 3 | 5 |
| F | 1 | 7 | 9 |
| C | E | 4 | 6 |
| O | 2 | 8 | A |

F C

| | | | |
|---|---|---|---|
| C | E | 4 | 6 |
| O | 2 | 8 | A |
| D | F | 5 | 7 |
| 1 | 3 | 9 | B |

F B

| | | | |
|---|---|---|---|
| D | F | 5 | 7 |
| 1 | 3 | 9 | B |
| E | O | 6 | 8 |
| 2 | 4 | A | C |

F E

| | | | |
|---|---|---|---|
| E | O | 6 | 8 |
| 2 | 4 | A | C |
| F | 1 | 7 | 9 |
| 3 | 5 | B | D |

F F

| | | | |
|---|---|---|---|
| F | 1 | 7 | 9 |
| 3 | 5 | B | D |
| O | 2 | 8 | A |
| 4 | 6 | C | E |

FIG. 9

F 0

| | | | |
|---|---|---|---|
| 1 | 0 | 1 | 0 |
| 1 | 0 | 1 | 0 |
| 0 | 0 | 0 | 0 |
| 0 | 0 | 0 | 0 |

F 1

| | | | |
|---|---|---|---|
| 0 | 0 | 0 | 0 |
| 0 | 0 | 0 | 0 |
| 0 | 1 | 0 | 1 |
| 0 | 1 | 0 | 1 |

F 2

| | | | |
|---|---|---|---|
| 0 | 1 | 0 | 1 |
| 0 | 1 | 0 | 1 |
| 0 | 0 | 0 | 0 |
| 0 | 0 | 0 | 0 |

F 3

| | | | |
|---|---|---|---|
| 0 | 0 | 0 | 0 |
| 0 | 0 | 0 | 0 |
| 1 | 0 | 1 | 0 |
| 1 | 0 | 1 | 0 |

F 4

| | | | |
|---|---|---|---|
| 1 | 0 | 1 | 0 |
| 1 | 0 | 1 | 0 |
| 0 | 0 | 0 | 0 |
| 0 | 0 | 0 | 0 |

F 5

| | | | |
|---|---|---|---|
| 0 | 0 | 0 | 0 |
| 0 | 0 | 0 | 0 |
| 0 | 1 | 0 | 1 |
| 0 | 1 | 0 | 1 |

F 6

| | | | |
|---|---|---|---|
| 0 | 1 | 0 | 1 |
| 0 | 1 | 0 | 1 |
| 0 | 0 | 0 | 0 |
| 0 | 0 | 0 | 0 |

F 7

| | | | |
|---|---|---|---|
| 0 | 0 | 0 | 0 |
| 0 | 0 | 0 | 0 |
| 1 | 0 | 1 | 0 |
| 1 | 0 | 1 | 0 |

F 8

| | | | |
|---|---|---|---|
| 1 | 0 | 1 | 0 |
| 1 | 0 | 1 | 0 |
| 0 | 0 | 0 | 0 |
| 0 | 0 | 0 | 0 |

F 9

| | | | |
|---|---|---|---|
| 0 | 0 | 0 | 0 |
| 0 | 0 | 0 | 0 |
| 0 | 1 | 0 | 1 |
| 0 | 1 | 0 | 1 |

F A

| | | | |
|---|---|---|---|
| 0 | 1 | 0 | 1 |
| 0 | 1 | 0 | 1 |
| 0 | 0 | 0 | 0 |
| 0 | 0 | 0 | 0 |

F B

| | | | |
|---|---|---|---|
| 0 | 0 | 0 | 0 |
| 0 | 0 | 0 | 0 |
| 1 | 0 | 1 | 0 |
| 1 | 0 | 1 | 0 |

F C

| | | | |
|---|---|---|---|
| 1 | 0 | 1 | 0 |
| 1 | 0 | 1 | 0 |
| 0 | 0 | 0 | 0 |
| 0 | 0 | 0 | 0 |

F D

| | | | |
|---|---|---|---|
| 0 | 0 | 0 | 0 |
| 0 | 0 | 0 | 0 |
| 0 | 1 | 0 | 1 |
| 0 | 1 | 0 | 1 |

F E

| | | | |
|---|---|---|---|
| 0 | 1 | 0 | 1 |
| 0 | 1 | 0 | 1 |
| 0 | 0 | 0 | 0 |
| 0 | 0 | 0 | 0 |

F F

| | | | |
|---|---|---|---|
| 0 | 0 | 0 | 0 |
| 0 | 0 | 0 | 0 |
| 1 | 0 | 1 | 0 |
| 1 | 0 | 1 | 0 |

FIG. 12

(1)

| | | | |
|---|---|---|---|
| 1 | 0 | 0 | 0 |
| 0 | 0 | 0 | 0 |
| 0 | 0 | 1 | 0 |
| 0 | 0 | 0 | 0 |

(3)

| | | | |
|---|---|---|---|
| 0 | 0 | 0 | 0 |
| 0 | 1 | 0 | 0 |
| 0 | 0 | 0 | 0 |
| 0 | 0 | 0 | 1 |

(2)

| | | | |
|---|---|---|---|
| 0 | 0 | 1 | 0 |
| 0 | 0 | 0 | 0 |
| 1 | 0 | 0 | 0 |
| 0 | 0 | 0 | 0 |

(4)

| | | | |
|---|---|---|---|
| 0 | 0 | 0 | 0 |
| 0 | 0 | 0 | 1 |
| 0 | 0 | 0 | 0 |
| 0 | 1 | 0 | 0 |

GRAY SCALE DISPLAY CONTROL DEVICE

BACKGROUND OF THE INVENTION

1. Field of the Invention

The present invention relates to a gray scale display (or gradation display) control device for controlling gradational display to be made on the screen of a display apparatus (or unit), such as a liquid crystal display apparatus, for performing binary (level) display.

2. Description of the Related Art

Generally, a frame thinning (out) method has been known as a method of performing gradational display on the screen of a liquid crystal display apparatus. This method is to divide a plurality of picture elements (namely, pixels) into groups (or clusters) by setting each of the clusters as consisting of, for example, 4*4 pixels (namely, 16 pixels) and to further make "pixel groups", which are arranged (or established) over a plurality of groups of pixels, correspond to gradation (or tone) levels, respectively, and to cause the "pixel groups" to blink every frame.

Multi-gray-scale (or multi-tone-level) display system based on such a frame thinning method is disclosed in Japanese Unexamined Patent Publication No. 1-225997. In accordance with this multi-gray-scale display system, as viewed in FIG. 10, pixels arranged in a matrix on the screen of a display apparatus are partitioned into groups (namely, clusters) so that each cluster consists of 16 pixels arranged in a matrix having 4 columns (namely, 4 pixels arranged in the X-direction (or the lateral direction)) and 4 rows (namely, 4 pixels arranged in the Y-direction (or the vertical or upward (or downward) direction)). Further, "pixel groups" P00 to P33 are set in such a manner as to correspond to pixels of each cluster, respectively. Moreover, lighting/non-lighting (status) signals, namely, blink signals, which respectively correspond to tone levels, are supplied to these "pixel groups" every frame, so that one screen picture representing a 16-gray scale display is constituted by 16 frames.

The number of times of changing the status of each of the "pixel groups" P00 to P33 between the lighting status and the non-lighting status, namely, that of times of blinking corresponding thereto varies with a corresponding gray scale (namely, to a corresponding tone level). In the case of an example utilizing the 16-gray scale display, when the gray scale is K0 in which a screenful white picture is displayed on the screen of the display apparatus, the number of frames, in which each of the "pixel groups" is lighted, among 16 frames is 0. This is indicated by a duty (cycle or factor) of 0/16. Further, when the gray scale is KF in which a screenful black picture is displayed on the screen of the display apparatus, the number of frames, in which each of the "pixel groups" is lighted, among 16 frames is 16. Namely, all through the 16 frames, the "pixel groups" are turned on (or lighted). This is indicated by a duty (cycle or factor) of 16/16. When the gray scale is within halftone gray scales (or levels) K1 to KE, the duty ranges from 2/16 to 15/16.

FIG. 11 is a diagram showing the display condition or mode of each of the "pixel groups" P00 to P33 in each frame in the case of, for example, the gray scale K1. In this figure, a high level (corresponding to a data value "1") of a data signal indicates that a corresponding "pixel group" is in a lighting status. Further, a low level (corresponding to a data value "0") of a data signal indicates that a corresponding "pixel group" is in a non-lighting status. As is seen from this figure, in the case that the gray scale is K1, namely, the duty is 2/16, the "pixel group" P00 is lighted up in a first frame F0 and a ninth frame F8. Further, a "pixel group" P01 is lighted up in a fifth frame F4 and a thirteenth frame FC. As shown in the rest of FIG. 11, the other "pixel groups" are similarly lighted up twice. Moreover, the display conditions or modes of all pixels of one group (or cluster) will be checked hereinbelow correspondingly to each frame. As shown in (1) of FIG. 12, the "pixel groups" P00 and P22 are lighted up in the first frame F0. Further, as shown in (2) of FIG. 12, the "pixel groups" P02 and P20 are lighted up in the second frame. Thereafter, similarly, the "pixel groups" P11 and P33 as lighted up in the third frame F2; and the "pixel groups" P13 and P31 in the forth frame F3, as illustrated in (3) and (4) of FIG. 12. Incidentally, the lighting condition or status of each of the "pixel groups" in the case of the gray scale K2 is illustrated in FIG. 13. Furthermore, the lighting condition or status of each of the "pixel groups" in the case of the gray scale K3 is illustrated in FIG. 14. However, the description of such conditions of the "pixel groups" is omitted for simplicity of description.

Further, the blinking conditions of the "pixel groups" (namely, "pixel groups" to be lighted up in the frames, respectively) are determined according to data preliminarily written to storage means (for instance, a shift register), which is provided in a conventional gray scale display control device, correspondingly to each gray scale.

The individual "pixel groups" P00 to P33 of each of groups partitioned in this manner are adapted in such a way as to be randomly selected and blinked every frame so that flickers are thereby prevented from being caused on the screen of a display apparatus. Moreover, such "pixel groups" P00 to P33 are adapted so that brightness (or luminance) changes respectively caused in the groups (or clusters) obtained by partitioning pixels are completely uniformed by synthesizing the blinking condition of each of such groups from those of the "pix groups" P00 to P33 corresponding to each gray scale. However, observers' feelings toward flickers varies with the blink rate of the pixels on the screen of the display apparatus and with unevenness in the distribution of (the positions of) the blinking (namely, lighting/non-lighting) pixels in each of the groups (or clusters). Therefore, if flickers occur in a specific gray scale (or tone level), the conventional gray scale display control device cannot reduce the flickers.

SUMMARY OF THE INVENTION

Accordingly, an object of the present invention is to provide a gray scale display control device that can easily reduce flickers in the case that the flickers once occur.

To achieve the foregoing object and in accordance with the present invention, there is provided a gray scale display control device (hereunder sometimes referred to as a first gray scale display control device of the present invention) which comprises: blink data storing means for storing blink data by which pixel groups of a display portion are blinked correspondingly to a gray scale; blink data generating means, to which the blink data stored in the aforesaid blink data storing means is written, for outputting the aforesaid blink data written thereto to the aforesaid display portion in such a manner as to be in a predetermined arrangement; and blink data arrangement means for determining an order in which the blink data written to the aforesaid blink data generating means are respectively arranged in (or assigned to) the "pixel groups". Further, the blink data written to the aforesaid blink data generating means is adapted to be able to be rewritten (namely, modified or updated).

Thus, in the case that flickers occur in pixels of the display portion, the pixels of the display portion can be blinked according to newly rewritten blink data. Consequently, a reduction in the flickers is achieved.

Further, in the case of an embodiment (hereunder sometimes referred to as a second gray scale display control device) of the first gray scale display control device of the present invention, the aforesaid blink data arrangement means comprises: a vertical synchronization counter; a horizontal synchronization counter; a clock counter; an adder for adding an output of the aforesaid horizontal synchronization counter and an output of the aforesaid clock counter to an output of the aforesaid vertical synchronization counter; and a decoder for randomly arranging the blink data, which is written to the aforesaid blink data generating means, according to an output of the aforesaid adder.

Thereby, the blink data can be randomly arranged. Consequently, a display, in which flickers are hard to occur, is realized.

Moreover, in the case of an embodiment (hereunder sometimes referred to as a third gray scale display control device) of the second gray scale display control device of the present invention, an addition order, in which an output of the aforesaid horizontal synchronization counter and an output of the aforesaid clock counter are added to an output of the aforesaid vertical synchronization counter, is able to be changed.

Thus, even if flickers occur, a reduction in the flickers is achieved by changing the addition order.

Furthermore, an embodiment (hereunder sometimes referred to as a fourth gray scale display control device of the present invention) of the third gray scale display control device of the present invention further comprises: a switch circuit provided between the aforesaid adder and each of the aforesaid horizontal synchronization counter and the aforesaid clock counter. In the fourth gray scale display control device of the present invention, the addition order is adapted to be changed by the aforesaid switch circuit.

Thus, the addition order is easily changed by this switch circuit.

BRIEF DESCRIPTION OF THE DRAWINGS

Other features, objects and advantages of the present invention will become apparent from the following description of a preferred embodiment with reference to the drawings in which like reference characters designate like or corresponding parts throughout several views, and in which:

FIGS. 5 and 6 are diagrams each for illustrating a decoder of the present invention;

FIG. 7 is a diagram for illustrating an operation of an adder of the present invention;

FIGS. 8 and 9 are diagrams for illustrating how blink data according to the present invention are arranged each frame;

FIGS. 11 to 14 are diagrams each for illustrating how conventional blink data are arranged every frame.

DETAILED DESCRIPTION OF THE PREFERRED EMBODIMENT

Figure 1:
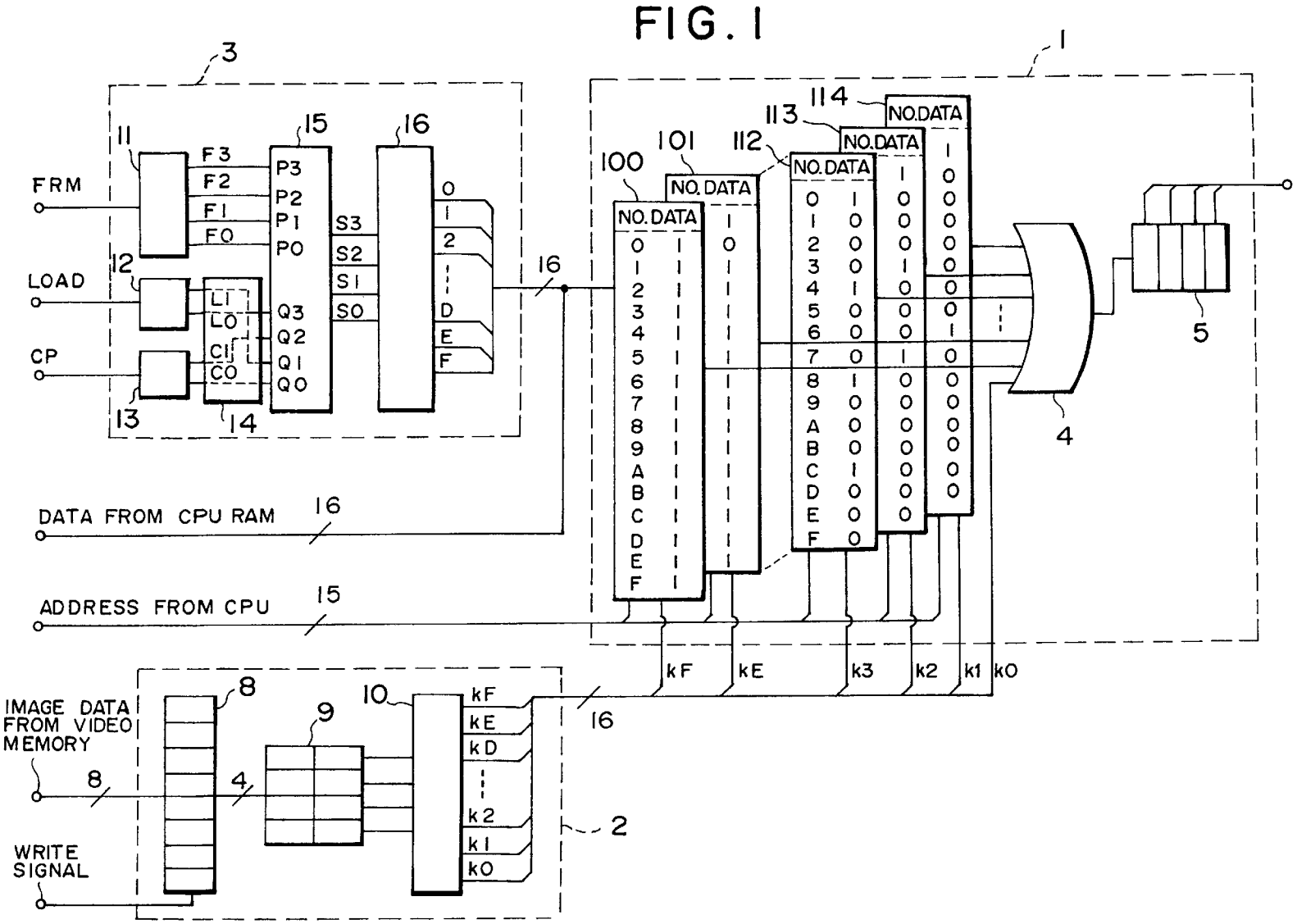
FIG. 1 is a block diagram showing the configuration of a primary part of a gray scale display control device of the present invention.
Figures 2, 3:
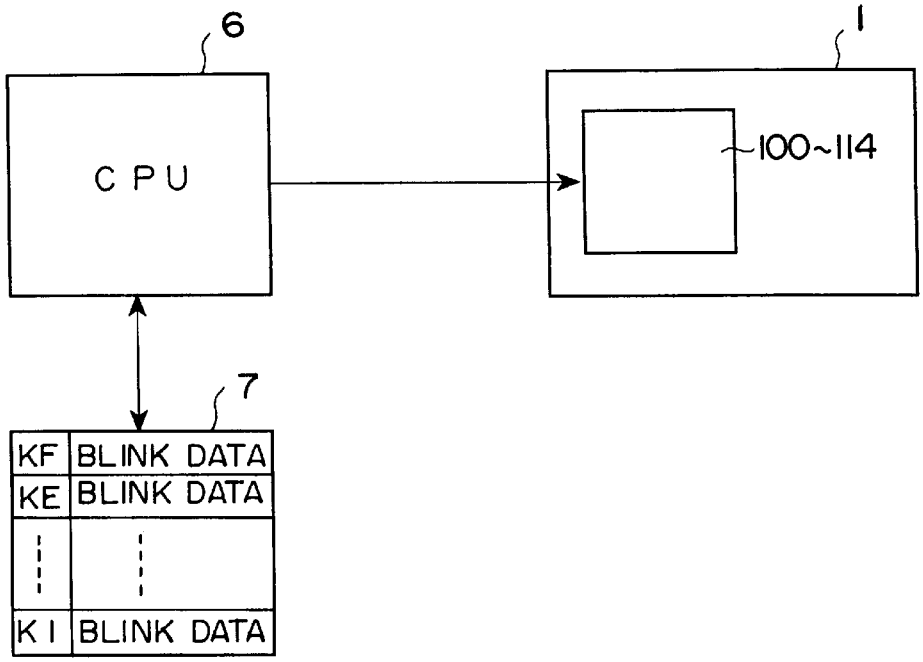
FIG. 2 is a block diagram illustrating how blink data of the present invention are stored.
FIG. 3 is a diagram illustrating blink data according to the present invention.
Figure 4:
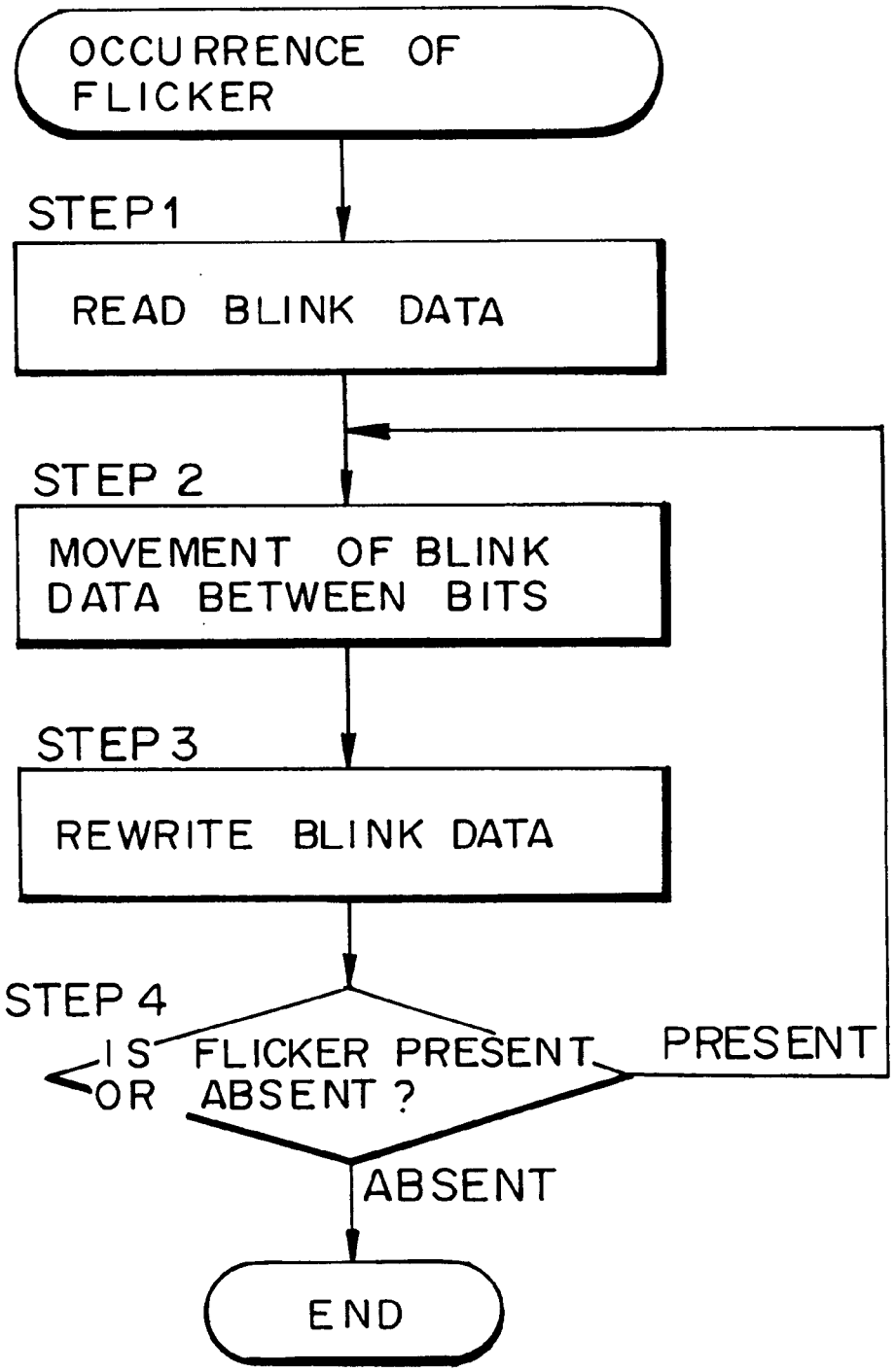
FIG. 4 is a flowchart for illustrating an operation of rewriting blink data according to the present invention.
Figure 10:
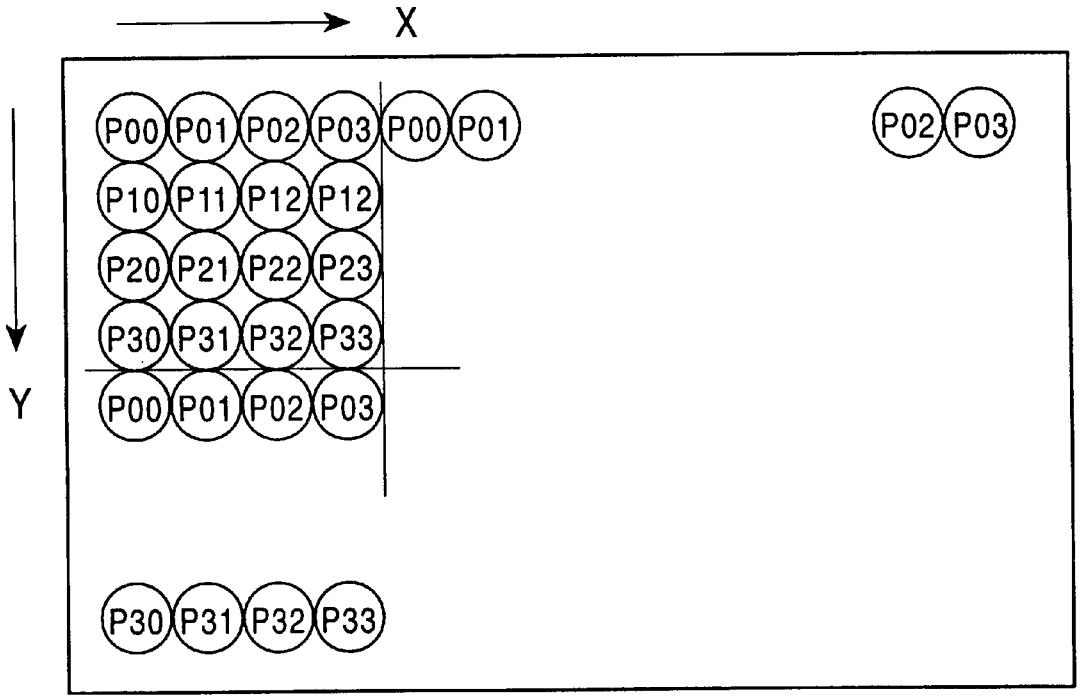
FIG. 10 is a diagram for illustrating "picture groups" of a display portion.
Figure 11:
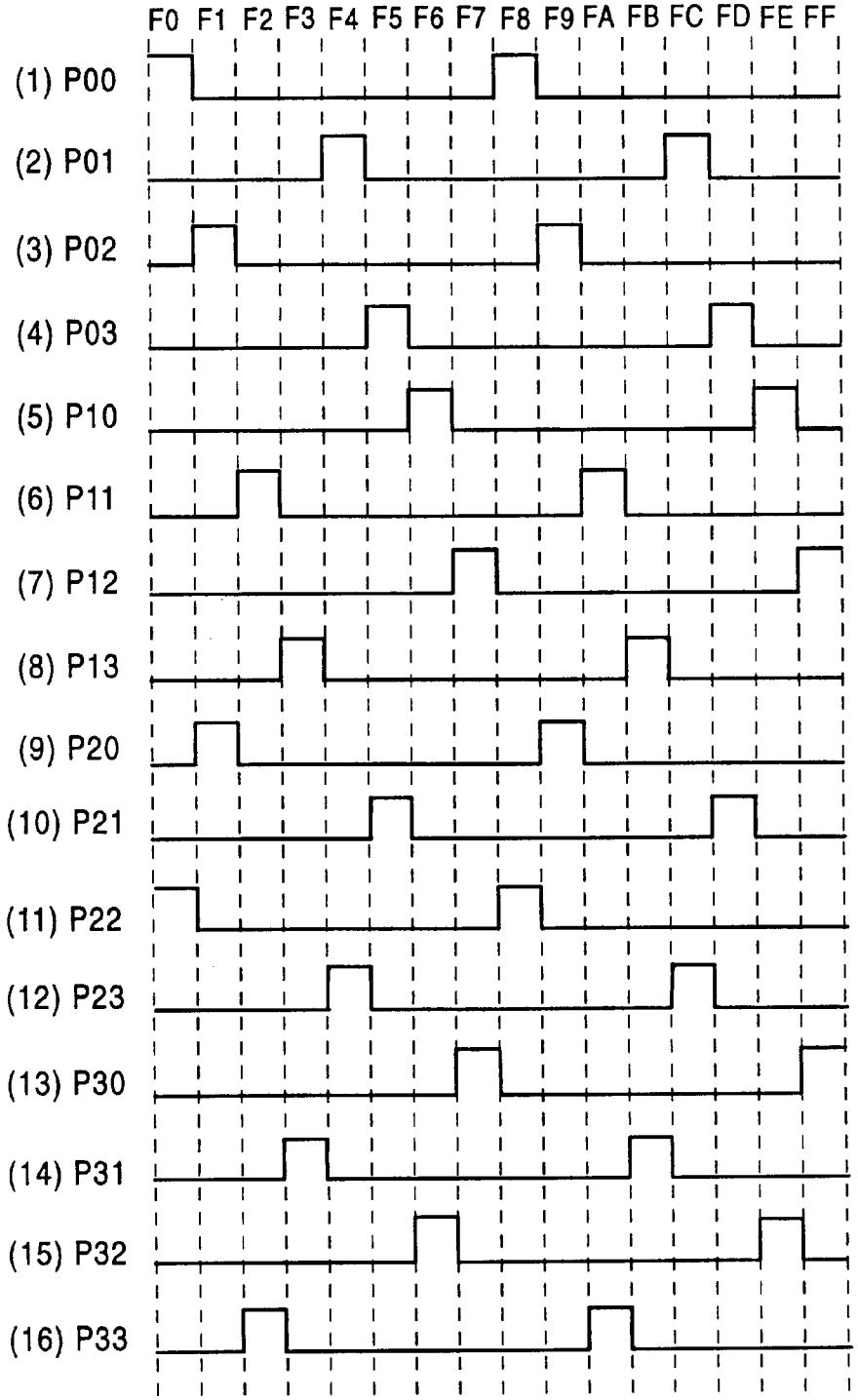
Figure 13:
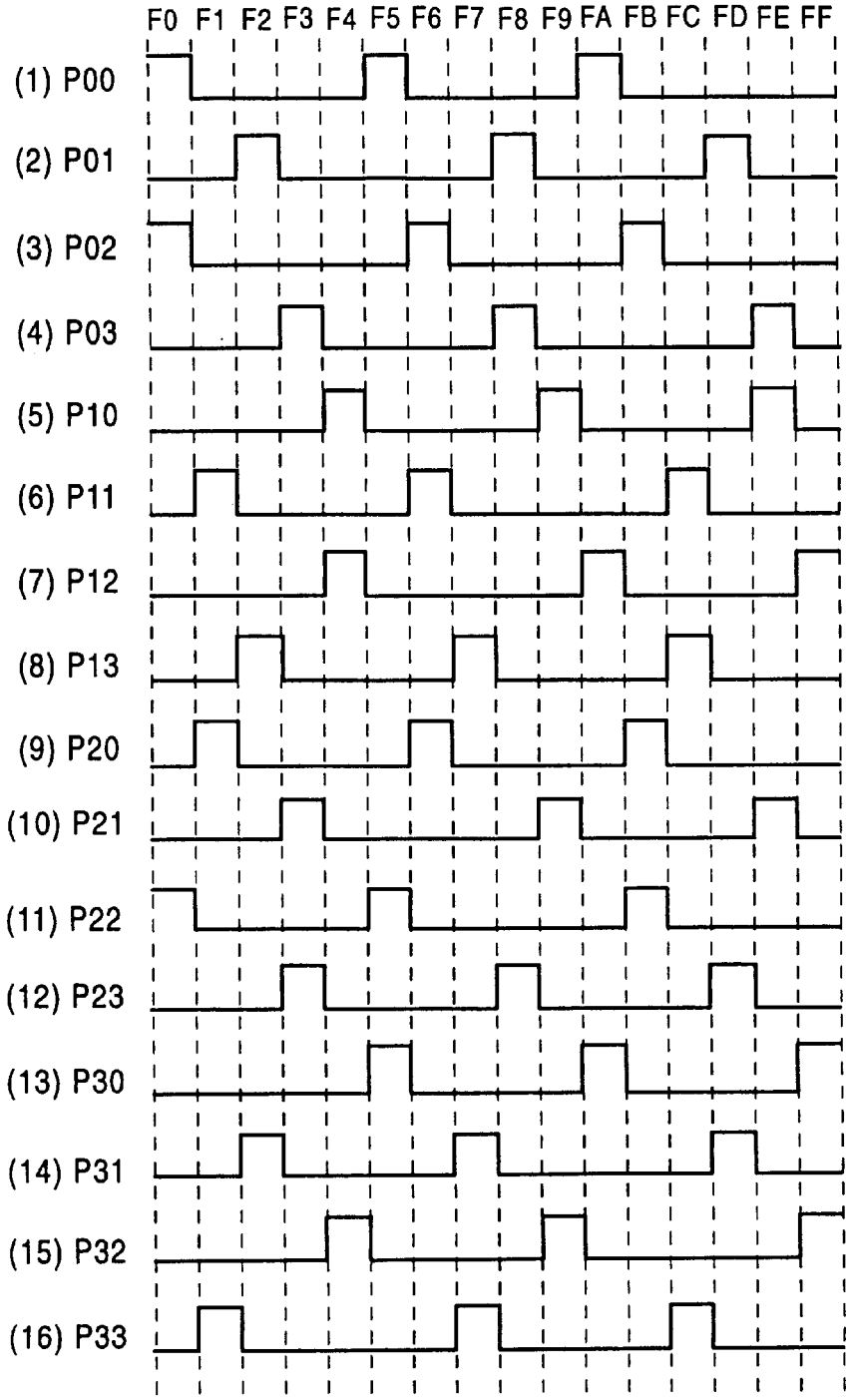
Figure 14:
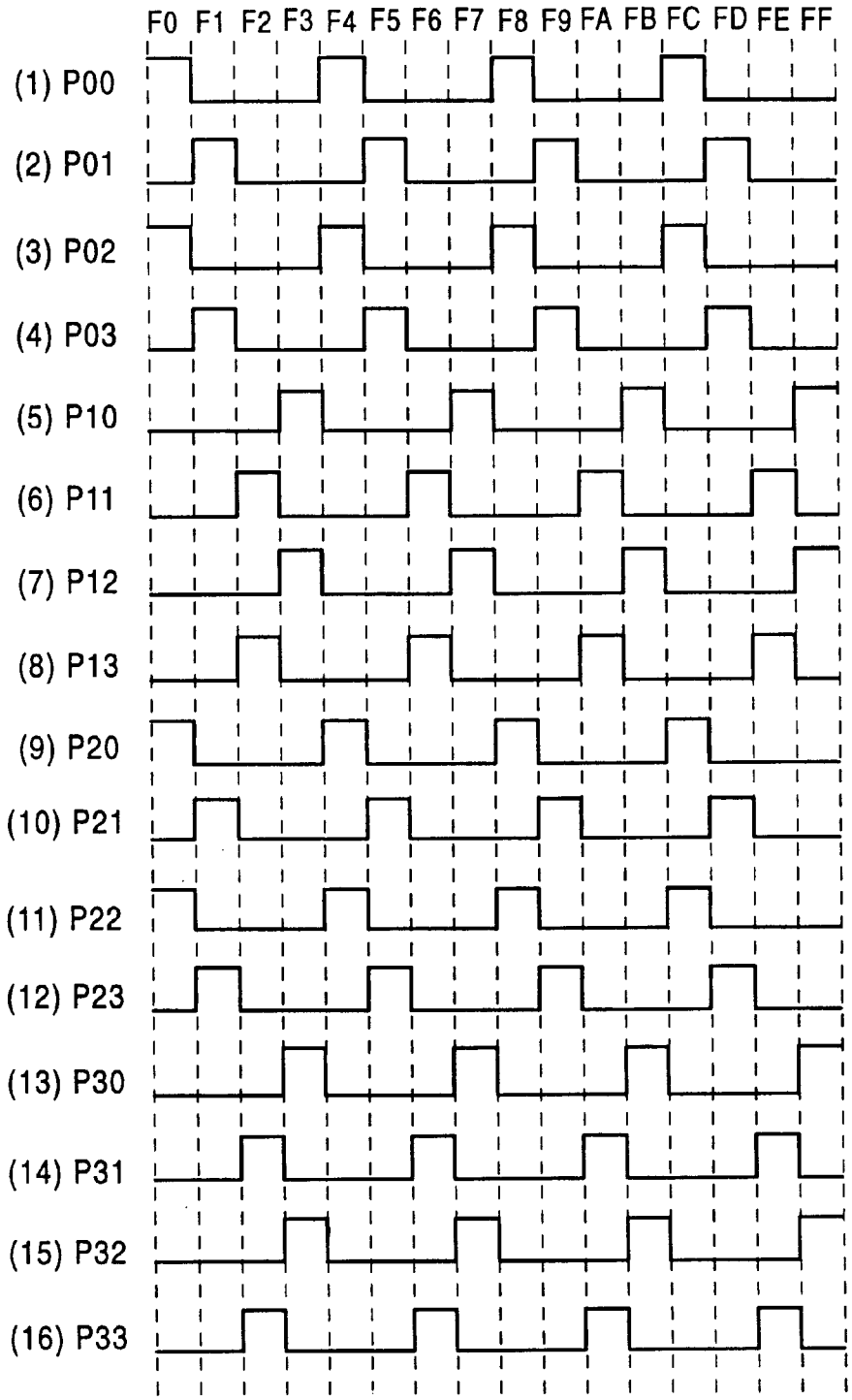

Hereinafter, the preferred embodiment of the present invention will be described in detail by referring to FIGS. 1 to 9. FIG. 1 is a block diagram showing the configuration of a primary part of a gray scale display control device of the present invention; FIG. 2 is a block diagram illustrating how blink data of the present invention are written; FIG. 3 is a diagram illustrating blink data according to the present invention; FIG. 4 is a flowchart for illustrating an operation of rewriting blink data according to the present invention; FIGS. 5 and 6 are diagrams each for illustrating a decoder of the present invention; FIG. 7 is a diagram for illustrating an operation of an adder of the present invention; and FIGS. 8 and 9 are diagrams for illustrating how blink data according to the present invention are arranged each frame.

FIG. 1 is a block diagram showing the configuration of the primary part of the gray scale display control device that supplies lighting/non-lighting data, namely, blink data to "pixel groups" P00 to P33 each frame and performs 16-gray scale display by using 16 frames. As shown in this figure, this gray scale display control device consists of: blink data generating means 1, to which blink data used for performing lighting/non-lighting operations on each "pixel group" correspondingly to a gray scale (or tone level) is written, for outputting the written blink data to a display portion (not shown); gray-scale selecting means 2 for selecting blink data, which is written to the blink data generating means 1 correspondingly to image (or picture) data sent from a video memory (not shown), according to a tone level; and blink data arranging means 3 for determining an order in which the blink data written to the blink data generating means 1 are arranged in (or assigned to) the "pixel groups" of the display portion, respectively.

The blink data generating means 1 is composed of: fifteen 16-bit registers 100 to 114; OR circuit 4 for ORing outputs of these registers 100 to 114; and what is called a "shift parallel register" (namely, a parallel shift register) 5 for sending outputs of the OR circuit 4 in groups of 4 bits to the display portion (not shown). Further, as shown in FIG. 2, blink data respectively corresponding to each of the tone levels (or gray scales (KF to K1)), which are written to the registers 100 to 114, are preliminarily stored in RAM 7. The blink data stored in RAM 7 are read therefrom by CPU 6 when the power supply for the display apparatus is turned on, and then, the read blink data are written to the registers 100 to 114, respectively. Moreover, this blink data is established in such a way as to be able to be rewritten. This will be described in detail later.

Each (data element) of such blink data is composed of 16 bits correspondingly to 16 tone levels, and is stored so that, for instance, as illustrated in FIG. 3, all of bits Nos. 0 to F are "1" in the case when the tone level (or gray scale) is KF, and that bits Nos. 0 and 8 are "1" and the other bits are zero in the case when the tone level is K1.

Moreover, as is seen from FIG. 3, the duty corresponding to the blink data varies with the tone level (or gray scale). Namely, in the case that the tone level is K1, the duty is 2/16. Furthermore, in the case that the tone level is KF, the duty is 16/16. Each of such blink data, which consists of 16 bits, is represented by a bit sequence (or string) of bits which are possible binary data values ("1" or "0") and arranged in the order of bit Nos. When blink data is rewritten, such a bit sequence representing this blink data is changed into a different bit sequence. Incidentally, in the case of the same tone level, even if the blink data is rewritten, the duty has a same value (namely, the number of (turned-on) bits which are "1" is unchanged).

FIG. 3 illustrates blink data, data elements of which are arranged and listed in the order of the bit Nos., as an example of the blink data written to the registers 100 to 114 of FIG. 1. Namely, in the case that the tone level (or gray scale) is KF (corresponding to black), all of 16 bits (namely, data values) respectively corresponding to the bit Nos. 0 to F are written to the register 100 as "1". Further, in the case that the tone level is KE, only the bit corresponding to the bit (No.) 1 is written to the register 101 as "0" (the other bits are written thereto as "1"). Furthermore, in the case that the tone level is k1 (namely, in the case of the lightest halftone level), the corresponding blink data is written to the register 114 so that the bits corresponding to the bit (Nos.) 0 and 8 are written to the register 114 as "1" and the other bits are written thereto as "0". Similarly, blink data respectively corresponding to the halftone levels KD to K2 are written to the registers 102 to 113, respectively (see also FIG. 1). Incidentally, in the case that the tone level is K0 (corresponding to white), all bits (or data values) are "0". Therefore, in this case, it is unnecessary to use such registers. Consequently, only the fifteen registers 100 to 114 are used for writing the blink data thereto.

Hereinafter, a process of rewriting the blink data written to the registers 100 to 114 will be described. This process is performed when a flicker occurs. Further, this operation is conducted according to the flowchart of FIG. 4. Namely, when a flicker occurs, a blink data rewriting instruction is issued to the CPU 6. Then, in STEP 1, the CPU 6 first reads the blink data, which respectively correspond to the tone levels, from the RAM 7. Subsequently, in STEP 2, the CPU 6 performs the movement (or exchange) of data values (or bits) among the bit positions (or locations) respectively corresponding to the bit Nos. In this case, the movement of the data values is carried out correspondingly to each tone level by using a random number generator or the like and selecting an arbitrary one of the bit Nos. respectively corresponding to bit locations, at each of which the data value "0" is held, and also selecting an arbitrary one of the bit Nos. respectively corresponding to bit positions, at each of which the data value "1" is held. Next, in STEP 3, the CPU 6 causes the RAM 7 to store new blink data that is obtained by performing the movement of the data values. Moreover, the CPU 6 replaces with the previous blink data, which have been written to the registers 100 to 114, with the new blink data. Then, in STEP 4, the control device checks whether or not a flicker occurs after the replacement of the previous blink data with the new blink data. If a flicker occurs, the control device issues an instruction for the CPU 6 (in STEP 4) to execute the operation to be performed in STEP 2. Thus, the operations to be performed in STEP 2 to STEP 4 are repeatedly conducted until flickers are eliminated. These operations are performed by executing programs preliminarily built in the CPU 6.

The gray scale selecting means 2 is composed of: an 8-bit buffer register; 2*4-bit shift register 9; and a 4–16 decoder 10. Further, the gray scale selecting means 2 is operative to read image data, which has been written to the video memory (not shown) and corresponds to each pixel, therefrom into the buffer register 8 thereof in synchronization with a clock pulse sent from a timing circuit (not shown). This image data corresponding to each pixel consists of 4 bits with a view to performing 16-gray scale display. For instance, in the case that this pixel is in the gray scale KF, the four bits (or four data values) are "1, 1, 1, 1", respectively. Further, in the case that this pixel is in the gray scale K0, the four bits (or four data values) are "0, 0, 0, 0", respectively. Such image data are read into the buffer register 8 by 8 bits (corresponding to two pixels) at a time. Then, the read image data is further inputted to the decoder 10 through the shift register 9.

The decoder 10 is operative to output signals respectively representing the tone levels KF to K0 to corresponding output lines kF to k0, respectively, on the basis of 4-bit image data corresponding to each pixel. For example, in the case that the image data has bits (or data values) "1, 1, 1, 1", the decoder 10 outputs a signal, which represents the tone level KF, to the output line kF. Further, in the case that the image data has bits (or data values) "1, 1, 1, 0", the decoder 10 outputs a signal, which represents the tone level KE, to the output line kE. Moreover, regarding the rest of the tone levels, the decoder 10 similarly outputs signals. For instance, in the case that the image data has bits (or data values) "0, 0, 0, 1", the decoder 10 outputs a signal, which represents the tone level K1, to the output line k1. Further, in the case that the image data has bits (or data values) "0, 0, 0, 0", the decoder 10 outputs a signal, which represents the tone level K0, to the output line k0. Furthermore, according to the output of the decoder 10, one of the registers 100 to 114 of the blink data generating means 1 is selected.

The blink data arrangement means 3 is operative to determine one of "pixel groups" (P00 to P33) of the display portion (not shown) as an object (or target), to which each of the data values (or bits) of the blink data of FIG. 3 written to the registers 100 to 114 of the blink data generating means 1, respectively, is assigned, and is also operative to blink the "pixel group" determined as such an object. Further, the blink data arrangement means 3 is composed of: a 4-bit counter (hereunder referred to as a vertical synchronization counter) 11 to which a vertical synchronization is inputted; a 2-bit counter (hereunder referred to as a horizontal synchronization counter) 12 to which a horizontal synchronization is inputted; another 2-bit counter (hereunder referred to as a clock counter) 13 to which a clock pulse is inputted; a switch circuit 14; an adder 15; and a decoder 16. Further, a vertical synchronization signal FRM, a horizontal synchronization signal LOAD and a clock pulse CP, which are sent from the timing circuit (not shown), are inputted to the vertical synchronization counter 11, the horizontal synchronization counter 12 and the clock counter 13, respectively. Moreover, outputs F0 to F3 of the vertical synchronization counter 11 are inputted to input terminals P0 to P3 on a side of the 4-bit adder 15, respectively. Furthermore, outputs L0, L1, C0 and C1 of the horizontal synchronization counter 12 and the clock counter 13 are inputted to input terminals Q0 to Q3 on the other side of the adder 15 through the switch circuit 14, respectively. In this 4-bit adder 15, an output of the horizontal synchronization counter 12 and an output of the clock counter 13 are added to an output of the vertical synchronization counter 11.

In the adder 15, the data values inputted to the input terminals Q0 to Q3 on one side thereof are added to the corresponding data values inputted to the input terminals P0 to P3 on the other side thereof, respectively. Thus, outputs S0 to S3 thereof are obtained. The switch circuit 14 is used for changing the combination of outputs of the vertical synchronization counter 11, the horizontal synchronization counter 12 and the clock counter 13 when the outputs of the counters 12 and 13 are added to the output of the counter 11.

In accordance with an adding method in this embodiment of the present invention, an output of the horizontal synchronization counter 12, an output C1 of the clock counter 13, an output L1 of the horizontal synchronization counter 12 and an output C1 of the clock counter 13 are added to outputs F0, F1, F2 and F3 of the vertical synchronization counter 11, respectively. Then, S3=F3+L0, S2=F2+C1, S1=F1+L1, and S0=F0+C0 are obtained as outputs of the 4-bit adder 15, respectively. Consequently, 4-bit output data values of the 4-bit adder 15 are presented as random patterns according to the combination of a vertical synchronization signal FRM, a horizontal synchronization signal LOAD and a clock pulse set from the timing circuit (not shown). Incidentally, the connection between the outputs L0, L1, C0 and C1, which are outputted from the horizontal synchronization counter 12 and the clock counter 13, and the input terminals Q0 to Q3 of the 4-bit adder 15 can be easily altered by the switch circuit 14. Additionally, in the case that the connection therebetween is changed, the output data value of the 4-bit adder 15 is presented as a different pattern.

An output of the adder 15 is inputted to the decoder 16, so that decoded sixteen outputs 0 to F are obtained as shown in FIG. 6. Such decoded outputs 0 to F thereof are outputted to corresponding output terminals thereof in synchronization with the inputting of a clock pulse CP thereto, and are operative to designate bit Nos. corresponding to bits of blink data written to the registers 100 to 115 of the blink data generating means 1. Note that the reason why a vertical synchronization signal is inputted to the 4-bit vertical synchronization counter 11 is to constitute one screen image, by which a 16-gray scale display is realized, by 16 frames. For example, in the case of a first frame F0, an output of the vertical synchronization counter 11 is "0, 0, 0, 0". At that time, an addition value obtained as a result of adding to the output of the vertical synchronization counter 11 to outputs of the horizontal synchronization counter 12 and the clock counter 13 is presented as data illustrated in FIG. 7, in synchronization with the inputting of a clock pulse CP thereto. This data is inputted to the decoder 16. Thereafter, output signals are outputted from output terminals of the decoder 16 in the following order according to FIG. 6 in synchronization with a clock pulse CP. Namely, the output signals of the decoder 16 appear at the output terminals 0, 2, 8, A, 4, 6, C, E, 1, 3, 9, B, 5, 7, D and F thereof in this order.

Outputs of this decoder 16 are used for designating the bit Nos. respectively corresponding to bits of blink data written to the registers 100 to 114 of the blink data generating means 1. Blink data written to the register selected by the blink data selecting portion 2 are read out in synchronization with a clock pulse CP in an order, at which the corresponding output signals are outputted from the aforementioned decoder 16, and are then sent to the display portion (not shown) through the OR circuit 4 and what is called the "shift parallel register" (ma,e;u. the parallel shift register) 5. Thus, a group (namely, a cluster) of 16 pixels respectively assigned to the "pixel groups" P00 to P33 are blinked sequentially. In the case of the remaining frames such as the second frame, similar operations are performed. However, the order, at which data values corresponding to the bit Nos. of bits of the blink data are outputted from the decoder 16, varies with the frames, so that flickers are prevented from occurring.

This situation is illustrated in FIG. 8. As is seen from this figure, the pattern of the bit Nos. of bits of the blink data to be respectively assigned to the "pixel groups" differs with the sixteen frames F0 to FF. Further, FIG. 9 illustrates the blinking conditions of 4*4 (=16) pixels of one certain group (or cluster), which are respectively assigned to the "picture groups" P00 to P33, in each of the frames in the case that the tone level is K3. In this embodiment of the present invention, bits of the blink data in the case of the tone level K3 are "1, 0, 0, 0, 1, 0, 0, 0, 1, 0, 0, 0, 1, 0, 0, 0" in the order of the bit Nos., as illustrated in FIG. 3. This blink data is written to the register 112 of the blink data storage portion 1 of FIG. 1. Further, in the case of the first frame F0, bits of this blink data, which respectively correspond to the bit Nos. 0, 2, 8, A, 4, 6, C, E, 1, 3, 9, B, 5, 7, D and F, are read in this order. Furthermore, the read bits of this blink data are respectively assigned to the "pixel groups" in sequence. Consequently, as shown in F0 of FIG. 9, the "pixel groups" P00, P02, P10 and P12 are lighted up. In this figure, the data value "1" corresponds to the lighting status; and "0" corresponds to the non-lighting status. In the rest of this figure, the blinking conditions of the "pixel groups" in each of the second to sixteenth frames F1 to FF are shown similarly.

Further, if the connection between outputs L0, L1, C0 and C1, which are outputted from the 2-bit counters 12 and 13, and the input terminals Q0 to Q3 of the adder 15 is changed by the switch circuit 14 of the blink data arrangement means 3, for example, in the case that a flicker occurs in the tone level K3, the order at which the data values respectively corresponding to the bit Nos. are outputted is changed. Thus, the positions of bits (or data values (namely, "1" or "0") of the blink data, which are assigned to the "pixel groups" P00 to P33, are changed. Thereby, the control device can search for a display condition in which few flickers occur.

Further, similarly, the control device instructs the CPU 6 to rewrite (or replace) the blink data. Moreover, the newly rewritten blink data is written to the registers 100 to 114 of the blink data generating means 1. Consequently, the new blink data written to the registers 100 to 114 are different from the previous or old data in respect of the data values corresponding to the bit Nos. Furthermore, the positions of bits (or data values), which are respectively assigned to the "pixel groups", of the blink data are changed. Thereby, a display condition, in which few flickers occur, is realized.

In the description given herein-above, the cases of performing monochrome 16-gray scale display has been described. However, in the case that images are displayed on the screen of a color liquid crystal display apparatus by using four kinds of colors, namely, R (red), G (green), B (blue) and W (white) as primary colors, the configuration of the gray scale display control device of the present invention is further simplified. In this case, it is confirmed by experiment that the color R is represented by blink data in the tone levels K1 to K8, that the color B is represented by blink data in the tone levels K9 to KE and that the color G is represented by blink data in the tone level KF. Therefore, typical tone levels K0, K5, KC and KF are selected among the tone levels K0 to KF illustrated in FIG. 3. Further, the blink data generating means 1 is configured in such a manner as to have three registers. Moreover, the blink data in the tone levels K5, KC and KF are written to the three registers. Furthermore, image data to be stored in the video memory (not shown) correspondingly to 4-color display is 2-bit data. Additionally, as a result of such a reduction in the number of bits (from 4 to 2), the configuration of the gray scale selecting means 2 is simplified.

Furthermore, in the case that images are represented by selecting four kinds of colors R, G, B and W, the presence or absence of flickers can be easily checked according to color. This facilitates the specification of a tone level in which a flicker occurs. Thus, in STEP 1 to STEP 4 of the flowchart of FIG. 4, the apparatus has only to rewrite merely blink data in the specific tone level, in which a flicker occurs. Consequently, the process of rewriting the blink data is simplified.

Although the preferred embodiment of the present invention has been described above, it should be understood that the present invention is not limited thereto and that other modifications will be apparent to those skilled in the art without departing from the spirit of the invention.

The scope of the present invention, therefore, is to be determined solely by the appended claims.

What is claimed is:

1. A gray scale display control device comprising:

blink data storing means for storing blink data by which pixel groups of a display portion are blinked correspondingly to a gray scale;

blink data generating means, to which the blink data stored in said blink data storing means is written, for outputting said blink data written thereto to said display portion in such a manner as to be in a predetermined arrangement;

blink data arrangement means for determining an order in which the blink data written to said blink data generating means are respectively arranged in the pixel groups, wherein the blink data written to said blink data generating means is adapted to be able to be rewritten; and blink data overwriting means for overwriting the blink data written in said blink data generating means when flicker occurs;

wherein said blink data arrangement means comprises:

a vertical synchronization counter;

a horizontal synchronization counter;

a clock counter;

an adder for adding an output of said horizontal synchronization counter and an output of said clock counter to an output of said vertical synchronization counter; and a decoder for randomly arranging the blink data, which is written to said blink data generating means, according to an output of said adder.

2. The gray scale display control device according to claim 1, wherein an addition order, in which the output of said horizontal synchronization counter and an output of said clock counter are added to an output of said vertical synchronization counter, is able to be changed, said addition order being changed when flicker occurs.

3. The gray scale display control device according to claim 2, which further comprises: a switch circuit provided between said adder and each of said horizontal synchronization counter and said clock counter, wherein the addition order is adapted to be changed by said switch circuit.

* * * * *